US008061672B1

(12) United States Patent
Kaufman

(10) Patent No.: US 8,061,672 B1
(45) Date of Patent: Nov. 22, 2011

(54) CLAMPING DEVICE FOR SECURING METAL STRUTS TO I-BEAMS FOR INTERIOR WALL CONSTRUCTION

(76) Inventor: Daniel Kaufman, Pasadena, CA (US)

( * ) Notice: Subject to any disclaimer, the term of this patent is extended or adjusted under 35 U.S.C. 154(b) by 464 days.

(21) Appl. No.: 11/688,211

(22) Filed: Mar. 19, 2007

Related U.S. Application Data

(60) Provisional application No. 60/784,227, filed on Mar. 20, 2006.

(51) Int. Cl.
*A47H 1/10* (2006.01)

(52) U.S. Cl. ..... 248/317; 248/228.3

(58) Field of Classification Search ..... 248/317, 248/72, 228.3, 231.41; 52/238.1, 714, 506.03, 52/506.07
See application file for complete search history.

(56) References Cited

U.S. PATENT DOCUMENTS

| | | | | | |
|---|---|---|---|---|---|
| 919,558 | A | * | 4/1909 | Doran | 248/72 |
| 1,134,519 | A | * | 4/1915 | Dietrich | 248/72 |
| 1,245,047 | A | * | 10/1917 | Sherman | 248/72 |
| RE17,629 | E | * | 3/1930 | Wehr | 104/111 |
| 1,832,315 | A | * | 11/1931 | McNulty | 248/59 |
| 1,974,628 | A | * | 9/1934 | Presley | 248/228.3 |
| 3,059,884 | A | * | 10/1962 | Stanfill | 248/68.1 |
| 3,292,888 | A | * | 12/1966 | Fischer | 248/72 |
| 3,998,028 | A | * | 12/1976 | Pelletier et al. | 52/834 |
| 4,073,108 | A | * | 2/1978 | Williams | 52/238.1 |
| 4,371,203 | A | * | 2/1983 | Munro | 294/119.1 |
| 4,908,915 | A | * | 3/1990 | Ruggles et al. | 24/336 |

* cited by examiner

*Primary Examiner* — Korie Chan
(74) *Attorney, Agent, or Firm* — Knobbe, Martens, Olson & Bear, LLP

(57) ABSTRACT

A securing device for securing a wall to an I-beam. The securing device includes two members that coupled to the sides of an I-beam and are secured together so as to couple the securing device to the I-beam. The two members define a surface that is spaced from the bottom surface of the I-beam that can receive fasteners and the thickness of the two member is such that ordinary fasteners can be used to secure a wall component to the two members of the securing device thereby reducing the need to drill, weld or otherwise attach wall members directly to the I-beam.

22 Claims, 6 Drawing Sheets

CLAMPING DEVICE FOR SECURING METAL STRUTS TO I-BEAMS FOR INTERIOR WALL CONSTRUCTION

RELATED APPLICATIONS

This application claims the benefit of U.S. Provisional Application No. 60/784,227 filed Mar. 20, 2006 which is hereby incorporated in its entirety by reference herein.

BACKGROUND OF THE INVENTION

1. Field of the Invention

The present invention relates to building construction and, in particular, concerns a clamping device for use with I-beams in order to mount interior walls in buildings.

2. Description of the Related Art

Mounting the interior walls of commercial buildings requires a significant effort. Conventionally, metal pieces, commonly referred to as "stickers", are welded at periodic intervals to load bearing I-beams, which support the building. An upper surface of a sticker is welded to the lower flange of an I-beam and a strut is attached to the lower surface of the sticker by screws or other fasteners. The strut is then used to frame the interior wall and provide an attachment point for other wall members, such as dry wall sheets and the like. In this fashion, the interior wall is supported by the I-beam without directly piercing the I-beam with mechanical fasteners, which can weaken the I-beam, in keeping with building code.

This fabrication method is expensive and time consuming, however. Welds must be performed by a welder who possesses significant, specialized experience. Furthermore, each sticker is welded over approximately 12 inches, requiring significant time to properly perform, even for an experienced welder. Additionally, the stickers are closely spaced along the I-beam, on the order of feet, meaning that numerous stickers are utilized in a building. Moreover, the welds must be inspected and tested to ensure they meet building code requirements. All of these factors significantly add to the time and cost of fabricating a building.

From the foregoing, it is apparent that there is need for a construction device for securing an interior wall of a building to an I-beam which may be deployed faster and at reduced cost than present devices. To this end, there is a need for a securing device that reduces the need for expensive weld attachments.

SUMMARY OF THE INVENTION

The aforementioned needs are satisfied by the present invention which, in one aspect, comprises a first and second bracket members that are adapted to engage opposing ends of a support beam, such as an I-beam. The first and second bracket members are engaged together by a securing member that clamps the first and second bracket members to the support beam. The first and second bracket members define a mounting surface that is spaced from the support beam wherein the mounting surface is adapted to receive fasteners to facilitate the interconnection of a wall member, such as a stud to the mounting surface without requiring the fasteners to be directly coupled to the support beam.

In one implementation, the support beam comprises an I-beam having a central member with legs extending perpendicularly outward from the central member at a first end of the central member. The first and second bracket members engage with the legs and a securing member is coupled therebetween so as to draw the first and second bracket members towards each other upon actuation of the securing member. The first and second bracket member define a mounting surface that extends generally parallel to the first and second legs but is spaced therefrom to facilitate fasteners being secured through the mounting surface without engagement with the legs of the I-beam.

In one specific implementation, the first and second bracket members are formed of sheet steel having a thickness that is selected to permit ordinary fasteners, such as screws, to be screwed therethrough. In one implementation, the mounting surface receives fasteners that couple a C-channel to the mounting surfaces. The C-channel then receives a wall component such as a stud, strut, joist or the like. Fasteners can then be used to couple the sidewalls of the C-channel to the stud, strut, joist or the like to thereby secure the member to the I-beam.

By allowing more mechanical attachment, rather than welded attachment of the brackets to the structural support beam, the cost of installation is reduced. Further, by forming a mounting surface that is spaced from the structural support beam, fasteners can then be used to more easily secure the wall components to the structural support beam.

These and other objects and advantages will become more apparent from the following description taken in conjunction with the accompanying drawings.

DETAILED DESCRIPTION OF THE PREFERRED EMBODIMENTS

Figure 2:
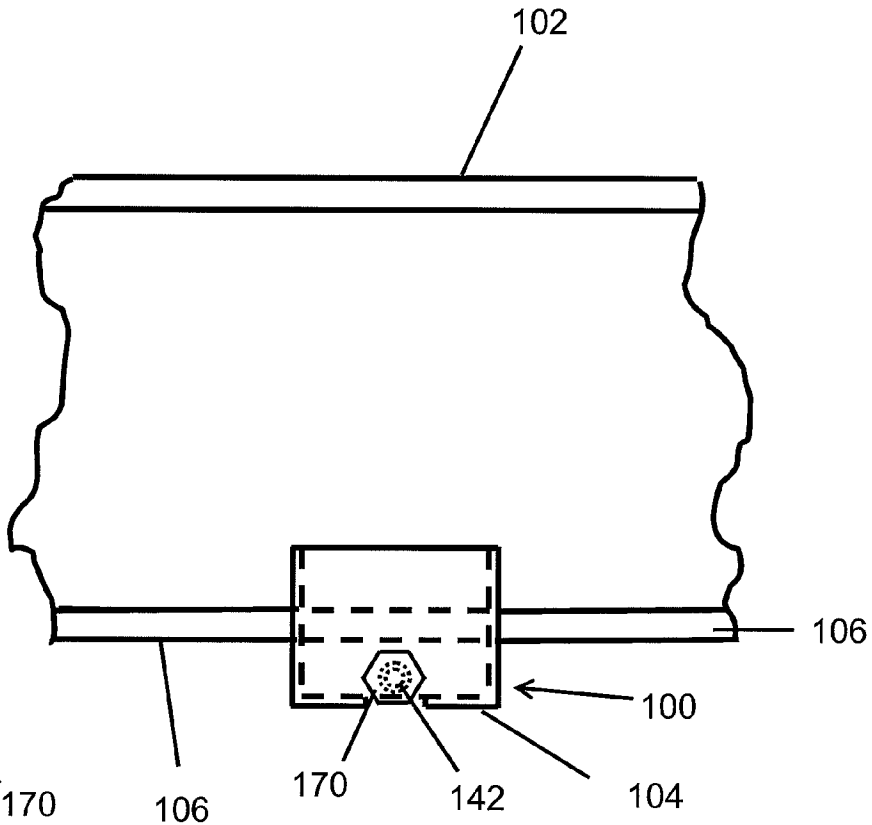
FIG. 2 is a side-elevation view of the clamping device of FIG. 1 attached to the I-beam.
Figure 1:
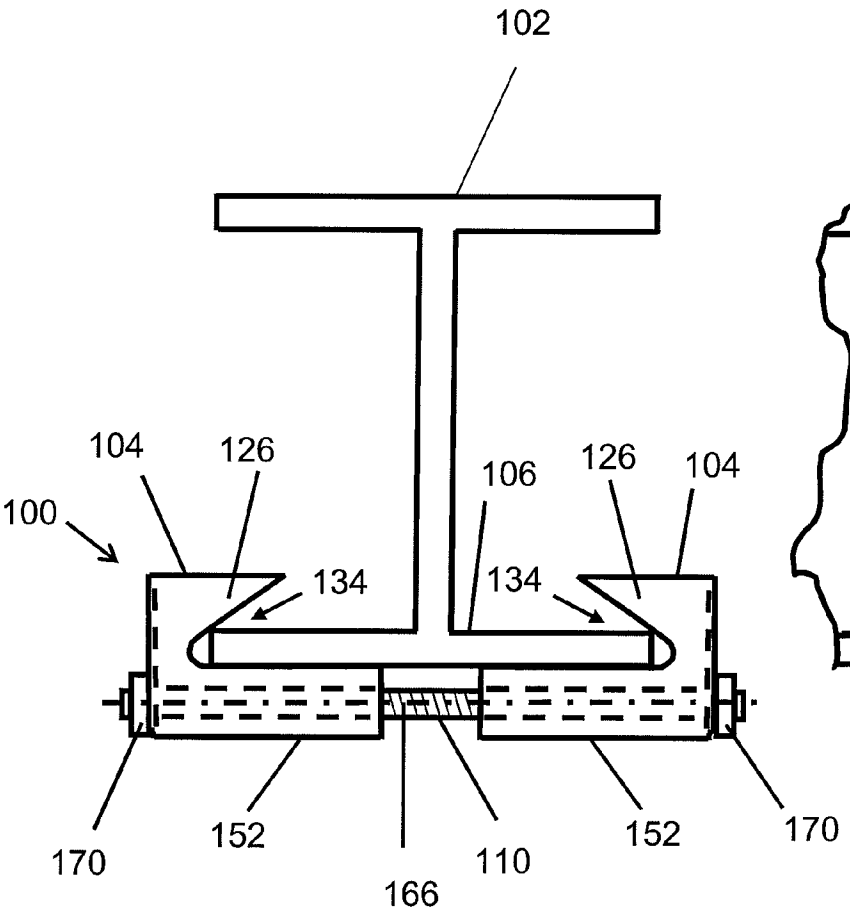
FIG. 1 is a front elevation view of one embodiment of a clamping device attached to an I-beam shown in cross-section.

FIGS. 1 and 2 present front and side elevation views of one embodiment of a clamping device 100 for use in securing a wall component, such as a stud, to a structural support such as an I-beam 102. In general, the device 100 is positioned around, and compressively secured to, the lower flange 106 of an I-beam 102. The underside of the device 100 provides a surface that is spaced from the I-beam to which struts or wall elements may be attached in the manner described below. Advantageously, as will described below, the device 100 may be quickly, yet firmly, secured to the I-beam 102 with less use of welds. The clamping device 100 comprises a plurality of clamp brackets 104 and a securing mechanism 110.

Figure 3:
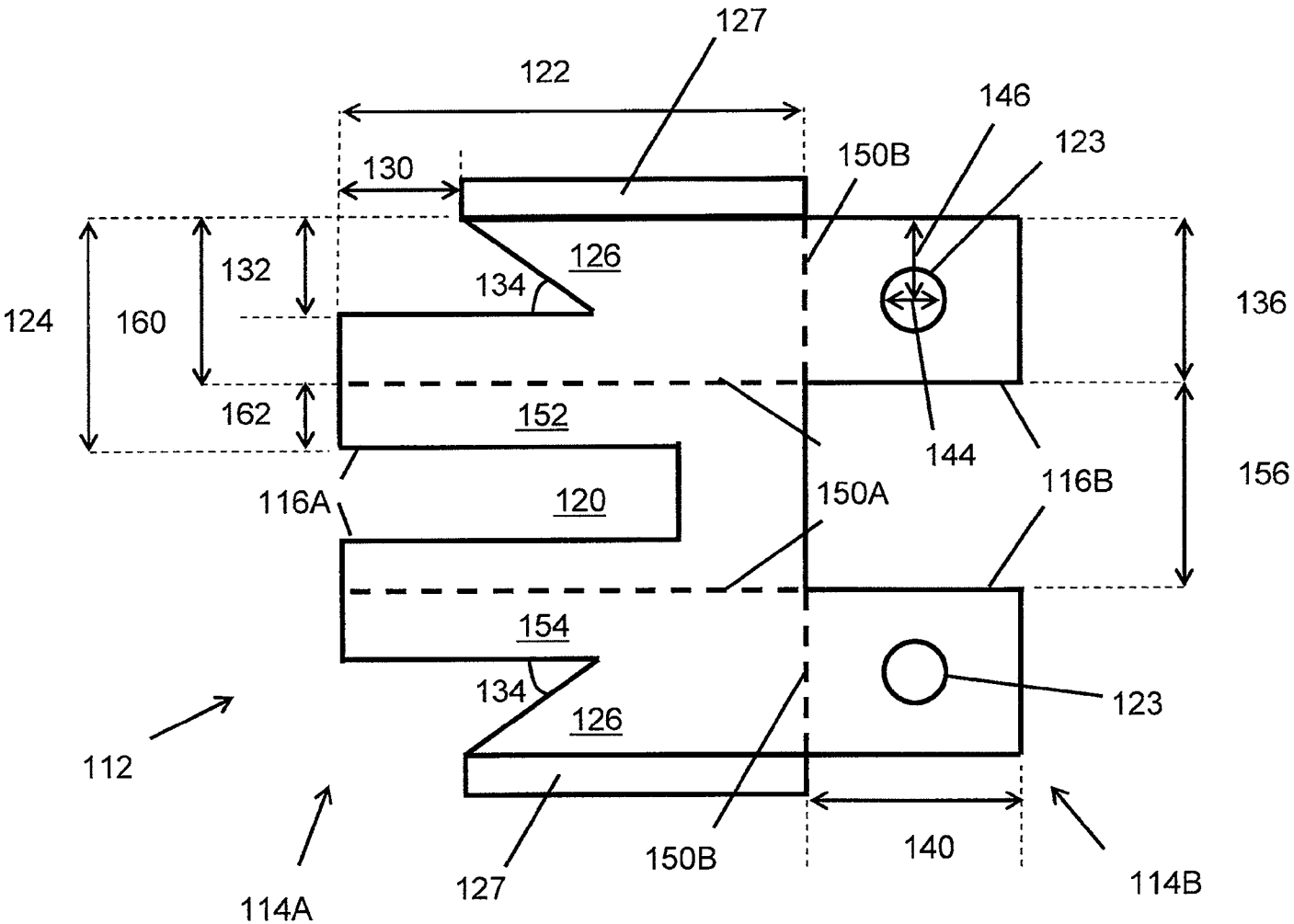
FIG. 3 is a top-down view of one embodiment of a clamp bracket, prior to folding to shape.

In certain embodiments of FIG. 1, the clamp brackets 104 may comprise a shaped metallic sheet 112 (FIG. 3) which is bent to the form of one of the clamp brackets 104. FIG. 3 presents one embodiment of the metallic sheet 112 prior to bending. The clamp bracket 104, prior to bending, comprises a substantially flat, metallic sheet 112 which is formed to a predetermined shape. The shape of the metallic sheet 112 may be achieved by stamping or other metal forming operations generally known to those knowledgeable in the art. In a preferred embodiment, the metallic sheet 112 comprises a steel alloy, however, other metals and metallic alloys may be utilized, as necessary. Advantageously, the metallic sheet 112 possesses a thickness not greater than a predetermined value in order to allow screws to easily pierce the clamp bracket 104 in order to attach struts to the bracket 104. In one embodiment, the sheet 112 is formed of sheet steel and has a thickness which less than about 1/32 inch. In another embodiment, the sheet 112 is formed of sheet steel and has a thickness not greater than about 3/16 inch.

In the embodiment of FIG. 3, the metallic sheet 112 is generally rectangular, possessing a first end 114A and a second end 114B. A first plurality of arms 116A extends outward towards the first end 114A, while a second plurality of arms 116B extends outward towards the second end 114B. The first plurality of arms 116A, serve as the base and sides of the clamp bracket 104 when the metallic sheet 112 is bent to shape. A gap 120 is also located between the first plurality of arms 116A. As discussed below in greater detail with respect to FIGS. 1-2, the gap 120 provides an opening by which fireproofing material may be sprayed within the interior surface of the clamp bracket 104 and the lower flange 106 of the I-beam 102. The first plurality of arms are preferably dimensioned to a clamp bracket length 122 of approximately 4" and a height 124 of approximately 3¼". A clamp portion 126 is also formed within each of the first plurality of arms 116A, configured so as to allow the clamp bracket 104 to engage the lower flange 106 of the I-beam 102. In the embodiment of FIG. 3, the clamp portion 126 defines a V-notch 134, however, the clamp portion 126 may comprise any shape which functions to engage the flange 106 of the I-beam 102. In the embodiment of FIG. 3, the V-notch possesses a V-notch offset length 130 of approximately ¾", a V-notch offset height 132 of approximately 1⅜", and a V-notch angle of approximately 45 degrees. As is also shown in FIG. 3, the outer edges of the clamp portion 126 define a fold 127 that can be folded so as to extend perpendicular to the clamp portion 126 to reinforce the clamp portion 126 so as to inhibit bending of the claim portion 126 in a direction that is perpendicular to the plane of the clamp portion 126.

The second plurality of arms 116B, as described below, forms the rear of the clamp bracket 104. The second plurality of arms 116B possesses, in one embodiment, a height 136 of approximately 2½" and a width 140 of approximately 3". An aperture 123 is further formed in each of the second plurality of arms 116B. The aperture 123 is generally circular, with an aperture diameter 144 dimensioned so as to allow the clamp bracket 104 to accept the securing mechanism 110, as discussed in greater detail below. The aperture 123 is positioned at an aperture positioning dimension 146 of approximately 1⅜" with respect to the edge of the second plurality of arms 116B. The clamp portion 126 and the aperture 123 will be discussed in greater detail below with respect to FIGS. 1-2 with respect to mounting the device 100.

Figure 5:
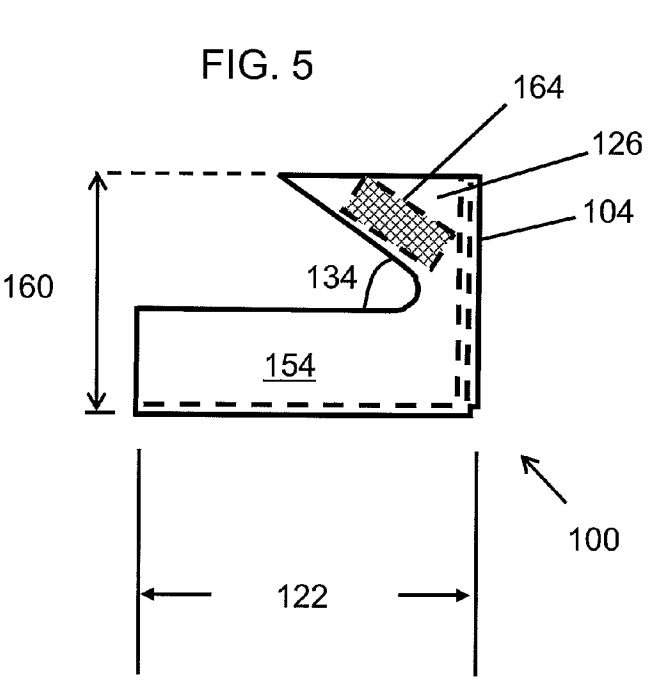
FIG. 5 is a front elevation view of the clamp bracket of FIG. 3 after folding to shape.
Figure 4:
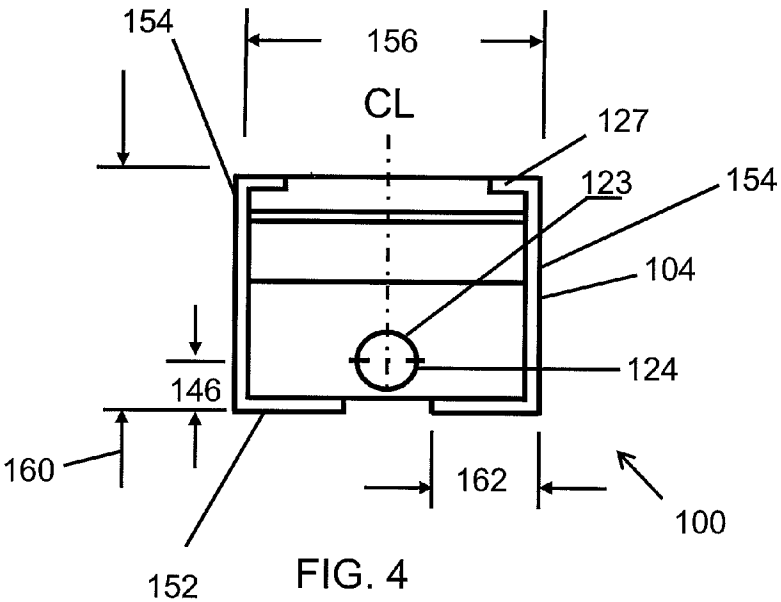
FIG. 4 is a left-side elevation view of the clamp bracket of FIG. 3 after folding to shape.

FIGS. 4 and 5 illustrate the metallic sheet 112 after it has been bent to the shape of the clamp bracket 104. To create this shape, the metallic sheet 112 is bent along a plurality of bends 150, comprising a first and a second plurality of bends 150B, illustrated in FIG. 3 by dashed lines. Generally, the metallic sheet 112 is bent approximately along the lines of the bends 150 towards the center of the metallic sheet 110 in order to form the clamp bracket 104. The first plurality of arms 116A are folded first, at the first plurality of bends 150A, to form an attachment portion 152 and clamp bracket sides 154 of the clamp bracket 104. As discussed below in greater detail with respect to FIGS. 1-2, the attachment portion 152 provides a location for attachment of struts to the clamp bracket 104. In the embodiment of FIGS. 3-5, the first plurality of bends 150A define a clamp bracket width 156 of approximately 3 inches, a clamp bracket height 160 of approximately 2½", and a clamp bracket flange dimension 162 of approximately ¾". The second plurality of arms 116B are folded next upon one another, at the second plurality of bends 150B, to form the rear of the clamp bracket 104. When bent in this fashion, the apertures 123 within each of the second plurality of arms 116B substantially overlap. Advantageously, the overlapping arms 116B reinforce the area about the aperture 123, helping to inhibit failure of the device 100 about the aperture 123, as will be discussed in greater detail with respect to FIGS. 1-2 below.

In further advantage, this design reduces the cost of the device 100. Metal sheet and metal forming and shaping operations of the type described above are relatively inexpensive. Furthermore, the metallic sheets 112 may be shipped in the planar form shown in FIG. 3 to a job site where they are bent to shape as needed, reducing the space and shipping cost of the device 100.

Figure 6:
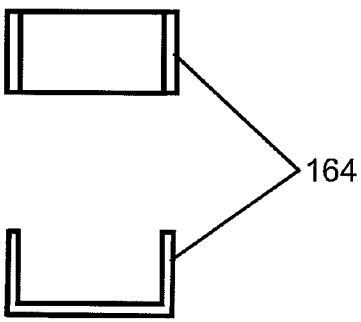
FIG. 6 is front and side elevation view of one embodiment of a support bracket for use with the clamp bracket.

In one embodiment of the clamp bracket 104, a support bracket 164 may also be interconnected to the clamp bracket 104 in order to further reinforce the clamp bracket 104. As illustrated in FIG. 6, the support bracket 164 comprises a generally C-shaped bracket. The support bracket 164 is configured so as to span the width 156 of the clamp bracket 104 and interconnect the sides of the clamp bracket 104 at approximately the position of the clamp portion 126, adjacent the V-notch 134 as illustrated in FIG. 5. The support bracket 164 may be attached to the clamp bracket 104 using welds, rivets, adhesives, or other joining methods. In this manner, the clamp bracket 104 is inhibited from buckling particularly about the V-notch 134.

Figure 8:
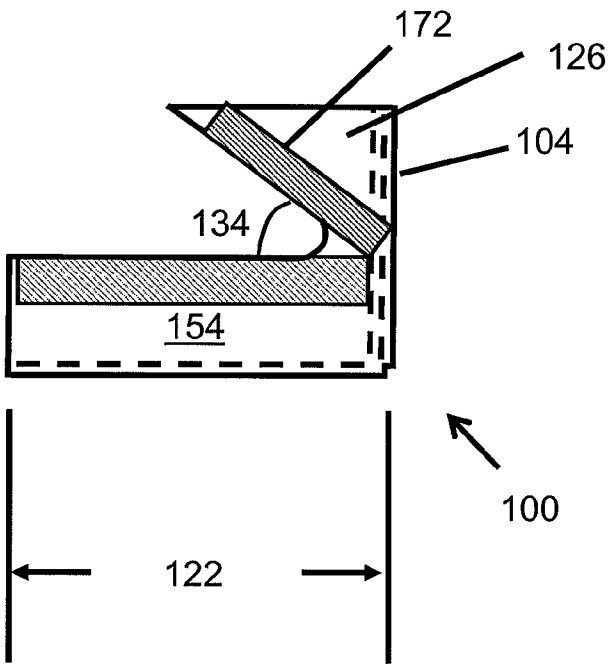
FIG. 8 is a side elevation view of the support bracket of FIG. 7 in use with the clamp bracket.
Figure 7:
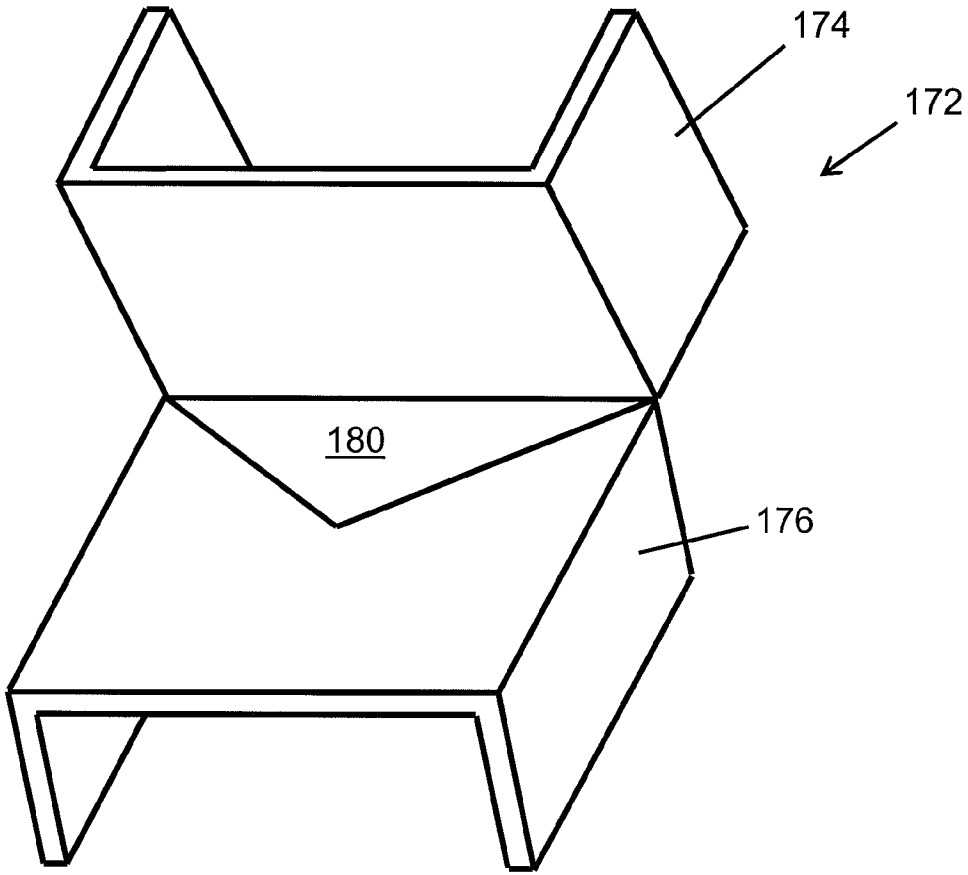
FIG. 7 is a perspective view of an alternative embodiment of the support bracket.

An alternative embodiment of a support bracket 172 which provides greater reinforcement to the clamp bracket 104, is illustrated in FIGS. 7 and 8. This alternative support bracket 172, shown in FIG. 7, comprises a first and a second generally C-shaped bracket portions 174 and 176 interconnected along one edge so as to define an angled V-shaped structure. An aperture 180 is formed in the second C-shaped bracket to allow fireproofing material to pass through the alternative support bracket 172, so as to coat the underside of an interconnected I-beam, when the device 100 is used.

As illustrated in FIG. 8, the alternative support bracket 172 is placed with the first and second bracket portions 174 and 176 are interconnected to the clamp bracket 104 at approximately clamp portion 126 and sides 154, respectively. More specifically, the support bracket 172 is shaped so as to fit within the clamp portion 126 and the attachment portion and couples to the interior walls of each about the V-notch 134. In this way, buckling is inhibited and reinforcing along the length 122 of the support bracket 104 is provided.

Returning to FIGS. 1-2, the clamp brackets 104 are mounted to the I-beam 102 using the securing mechanism 110. In the embodiment of FIGS. 1-2, a pair of clamp brackets 104 are inserted into opposing ends of the lower flange 106 of the I-beam 102 at the clamp portion 126, such that the ends of the flange 106 of the I-beam 102 are positioned within the V-notch 134. Each of the clamp brackets 104 are substantially aligned with respect to the aperture 123 so as to allow the securing mechanism 110 to interconnect the pair of the clamp brackets 104 and pull the pair of clamp brackets 104 towards each other with the flange 106 of the I-beam 102 interposed therebetween. In this fashion, the securing mechanism 110 compressively secures each of the clamp brackets 104 to the I-beam 102. When mounted in this fashion to the I-beam 102, the device 100 is oriented with the attachment portion 152 facing below and being spaced from the flange 106. In this manner, the device 100 provides a location for wall members, such as studs, struts and the like to be mounted to the clamping device 104. Advantageously, the attachment portion 152 is designed to be thin enough to allow fasteners, such as screws, to penetrate, allowing the attachment of wall components to the clamping device 100 more quickly and less expensively. In further advantage, when the device 100 is mounted to an I-beam, the gap 120 in the clamping device 104 allows fireproofing material sprayed on the I-beam and device 100 to enter and coat the interior of the device 100 as well as coat the lower flange 106, facilitating compliance with fire code regulations.

In certain embodiments, the securing mechanism 110 may comprise a threaded rod 166 and a plurality of nuts 170. The threaded rod 166 is preferably dimensioned so as to fit within the aperture 123 of each of the clamp brackets 104 and to substantially span the distance between clamp brackets 104 engaged with the lower flange 106 of an I-beam 102. In one embodiment, the diameter of the threaded rod is approximately ⅜". The nut 170 is mounted on the end of the threaded rod 166 and threaded so as to urge the clamp bracket 104 towards the flange 106 of the I-beam 102. In one advantage, the nut 170 may be tightened on the threaded rod 166 so as to compressively engage the clamp brackets 104 with the flange 106 of the I-beam 102 with a force sufficient to prevent the clamp brackets 104 from moving with respect to the I-beam 102.

In one advantage, the overlapping second plurality of arms 116B reinforce the area of the device 100 about the aperture 123. When the device 100 supports an interior wall, the weight of the wall pulls the device downward. As a result, the threaded rod 166 presses against the edge of the aperture 123. Therefore, reinforcing the aperture 123 increases the load bearing capacity of the device 100 about the aperture 123, reducing the likelihood of failure of the device 100 at the aperture 123 and enhances the robustness of the device 100.

Figure 9:
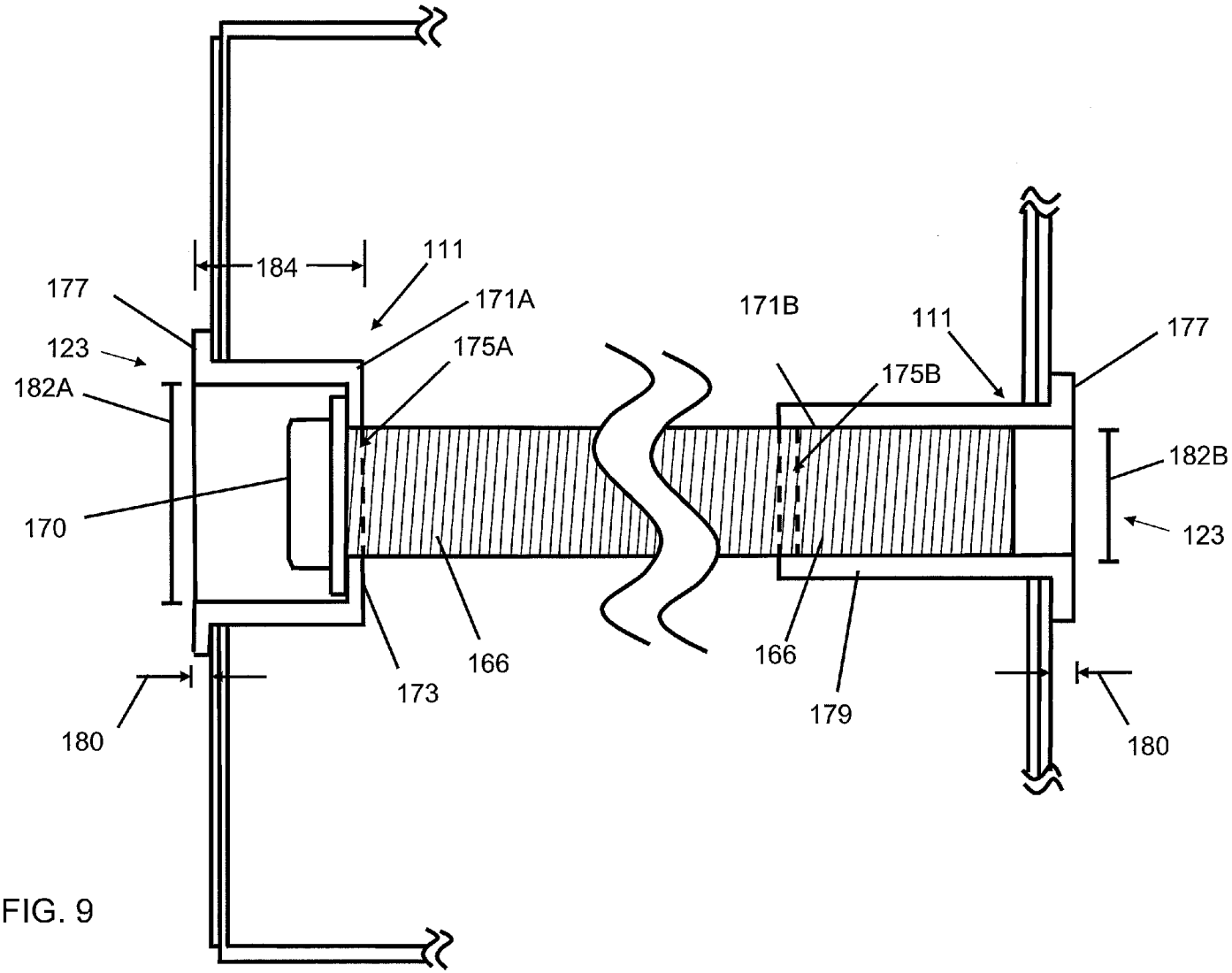
FIG. 9 is an elevation view of an alternative securing mechanism for the device of FIG. 1.
Figure 10:
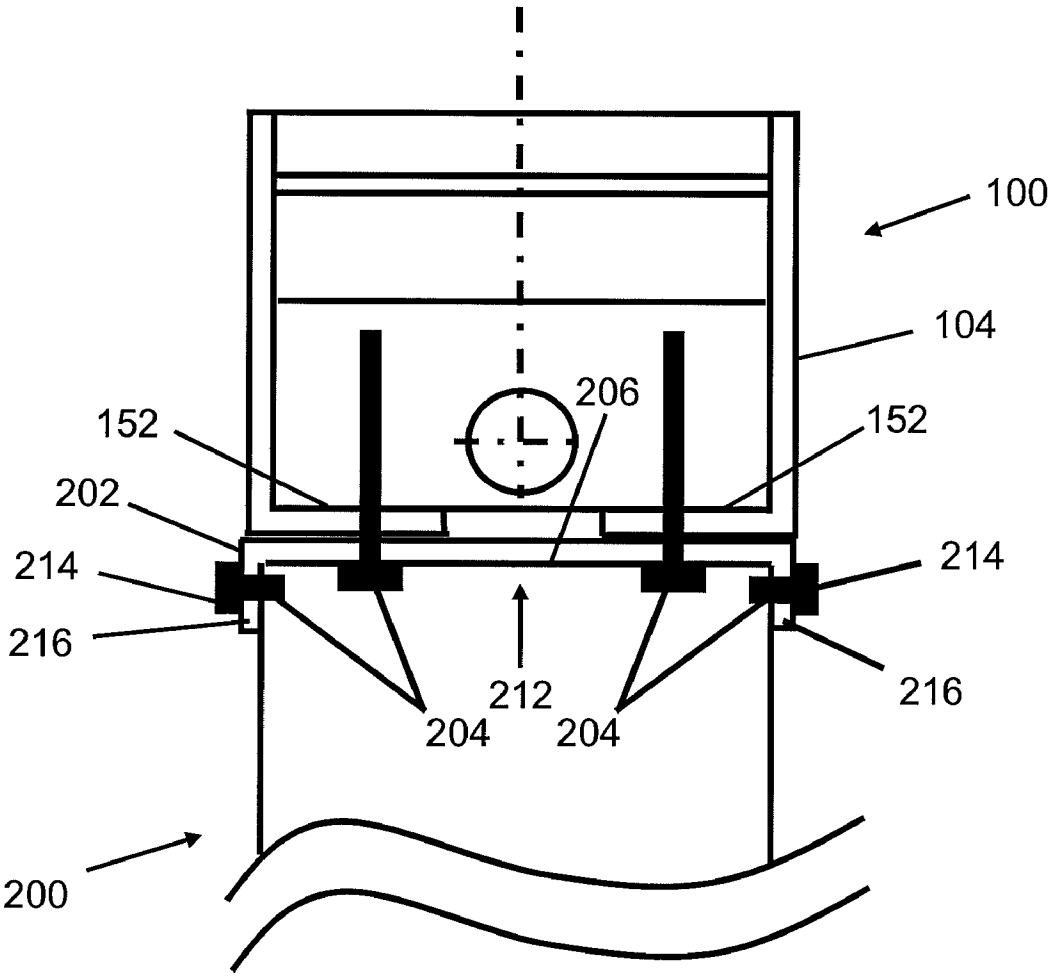
FIG. 10 is a partial elevation view of an exemplary wall built using the devices of FIGS. 1 and 9.

FIG. 9 illustrates an alternative securing mechanism 111. In this securing mechanism, instead of the nut 170 positioned on the outer surface of the arms 116A, 116B, the apertures 123 receive first and second inset nuts 171A, 171B. The inset nuts 171A, 171B possess flanges 177 that define mouths 182A, 182B which extend about the outer surface of the aperture 123 so as to secure the inset nuts 171A, 171B in the apertures 123. Inset nut 171A further defines a recessed surface 173 which has an aperture 175A that receives the threaded rod 166. In one embodiment, the inset nut 171A terminates at about the recessed surface 173, providing a position to receive the nut 170. In another embodiment, the inset nut 171B possesses a threaded receiving portion 179 with an aperture 175B configured to receive and secure the threaded rod 166. In this manner, the inset nuts 171A, 171B allow the nut 170 and threaded rod 166 of the alternative securing mechanism 111 to be inset with respect to the outer surface of the arms 116A, 116B which facilitates finish treatment of the walls as the flange 177 extends outwardly from the outer surface of the arms 116A, 116B a distance that is less than the distance of the nut 170. Thus, it is easier to make a smooth appearing wall surface when applying drywall and the like. In one embodiment, the flange possesses a width 180 of approximately 3/32 inch and the diameter of the mouth 182 is approximately 11/16 inch. In another embodiment, the recessed surface 173 and mouth 182 of the of the inset nut 171A are spaced apart by a width 184 of approximately 1 inch FIG. 10 illustrates the clamp members 104 as they are used to provide support for a wall 200. As shown, two clamp members 104 are positioned on either side of the I-beam 102 in the manner shown in FIG. 1. The clamp members 104 are secured together with the securing mechanism 110 so that the assembly is rigidly coupled to the I-beam 102. The lower surface of the clamp members 104 define the attachment portions 152. A C-channel member 202 can then be positioned proximate the attachment portions 152 and fasteners 204 can then be secured through the bottom surface 206 of the C-channel member 202 through the attachment portion 152. The bottom surface 152 is preferably spaced from the bottom surface of the I-beam 102 a distance that is selected to permit the fasteners 204 to extend into the interior space of the clamp members 104 without contacting the I-beam.

Subsequently, a wall member 200 can then be positioned within the recess 212 defined by the C-channel member 202 and the wall member 210 can then be secured within the C-channel 202 via fasteners 214 that extend through the side walls 216 of the C-channel member 202. The wall member 200 can comprise any of a number of known light steel or wood wall construction members including studs, struts, joists or the like. Similarly, C-channel attachment can then be provided on the opposite side (not shown) of the wall 200 in a known manner. The wall members will include structural members that extend the height of the wall and then other wall components such as drywall, insulation, and the like will be added in a manner known in the art.

In further advantage, the design of the device 100 allows a construction worker of average skill to mount the clamping device 100 to the I-beam 102, not just skilled welders, reducing the cost of installing the clamping device 104. In this manner, the device 100 may be quickly, yet securely fastened to an I-beam 102, reducing the cost and the time required to erect interior walls in buildings.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

What is claimed is:

1. A clamping device for securing struts to an I-beam for interior wall construction, comprising:

a plurality of clamp brackets, wherein each clamp bracket comprises a clamp portion configured to engage at least a portion of the flange of an I-beam, at least one clamp bracket side for supporting the clamp bracket, an attachment portion configured to allow attachment to and support of at least a portion of a strut so as to support an interior wall, and a securing portion wherein the clamp portion, the at least one clamp bracket side, and the attachment portion and the securing portion are formed from a single folded metallic sheet and wherein the securing portion is formed of two overlapping pieces of the metallic sheet;

a securing mechanism, wherein the securing mechanism engages with the securing portion, interconnects and compressively secures at least two of the plurality of clamp brackets to the flange of an I-beam.

2. The device of claim 1, wherein the clamp bracket further comprises at least one support fold adapted to inhibit bending of the clamp portion, and wherein the at least one support fold, the clamp portion, the at least one clamp bracket side, and the attachment portion are formed from a single folded metallic sheet.

3. The device of claim 1, wherein the clamp bracket possesses a thickness not greater than about 3/16 inch, so as to allow screws to penetrate the clamp bracket.

4. The device of claim 1, wherein the securing mechanism comprises a threaded rod and nut.

5. The device of claim 4, wherein the securing mechanism is interconnected to the at least one clamp bracket at an aperture formed within the at least one clamp bracket.

6. The device of claim 5, wherein the aperture is reinforced so as to inhibit failure of the device at the aperture.

7. The device of claim 1, wherein the clamping device further comprises a support bracket which reinforces the device so as to substantially inhibit buckling.

8. The device of claim 1, wherein the clamping device allows fireproofing material sprayed on the device to coat the interior of the device.

9. The device of claim 1, wherein the clamping device, when mounted to an I-beam, allows fireproofing material sprayed onto the I-beam and device to coat the interior of the device and the flange of the I-beam.

10. A device for securing wall components to a structural beam of a building, the device comprising:

a first and second member that couple to opposing sides of the structural beam, the first member having a clamp bracket side, a clamp portion and a securing portion formed of two overlapping pieces of the first metallic sheet formed from a first metallic sheet and the second member having a clamp bracket side, a clamp portion and a securing portion formed of two overlapping pieces of the second metallic sheet formed from a second metallic sheet;

a securing apparatus that interconnects the first and second member wherein the securing apparatus urges the first and second member towards each other with the structural beam interposed therebetween so that the securing member inhibits removal of the first and second member from the structural beam; and wherein the first and second member, when mounted on the structural beam define a mounting surface that is spaced from the structural member so as to receive fasteners therethrough to permit coupling of the wall components to the structural beam without the fasteners contacting the structural beam.

11. The device of claim 10, wherein the first and second members are clamp members that define recesses adapted to receive the outer edges of a flange on an I-beam wherein the clamp members further define a securing section located below the recesses wherein the securing apparatus is coupled to the securing section.

12. The device of claim 11, wherein the mounting surface is formed so that the securing section is interposed between the recesses that receive the flange edges of the I-beam and the mounting surface and wherein the first and second member are sized so as to receive the fasteners so that the fasteners do not contact the structural beam.

13. The device of claim 10, wherein the securing apparatus comprises a threaded rod that engages with at least one nut on one of the first and second members so that the clamp members are drawn together and separated by rotation of the threaded rod.

14. The device of claim 11, wherein the securing section defines a first surface and wherein the at least one nut is an inset nut that is recessed from the first surface.

15. The device of claim 10, wherein the first and second members are formed of sheet steel having a thickness of less than about 1/32 of an inch.

16. The device of claim 10, wherein the first and second members define an interior spaces and wherein the device further comprises at least one reinforcing member positioned within the interior space so as to inhibit buckling of the first and second member.

17. The device of claim 10, wherein the mounting surface defines a gap so as to permit application of fire retardant to the structural support through the gap.

18. A system for mounting wall components to a structural beam of a building, the system comprising:

a first and second member that couple to opposing sides of the structural beam, wherein the first and second members define a mounting surface that is spaced from the structural beam, the first member having a clamp bracket side, a clamp portion and a securing portion formed from a first metallic sheet and the second member having a clamp bracket side, a clamp portion and a securing portion formed of two overlapping pieces of the second metallic sheet formed from a second metallic sheet;

a securing apparatus that engages the securing portions and interconnects the first and second member wherein the securing apparatus urges the first and second member towards each other with the structural beam interposed therebetween so that the securing member inhibits removal of the first and second member from the structural beam;

a plurality of generally C-shaped channel members secured proximate to the mounting surfaces of the first and second members such that sidewalls of the plurality of channel members define a recess capable of receiving a wall member for securement to the plurality of C-channel members.

19. The device of claim 18, wherein the first and second members are clamp members that define recesses adapted to receive the outer edges of a flange on an I-beam wherein the clamp members further define a securing section located below the recesses wherein the securing apparatus is coupled to the securing section.

20. The device of claim 19, wherein the mounting surface is formed so that the securing section is interposed between the recesses that receive the flange edges of the I-beam and the mounting surface and wherein the securing section defines a space that is sized so as to receive the fasteners so that the fasteners do not contact the structural beam.

21. The device of claim 18, wherein the first and second members are formed of sheet steel having a thickness not greater than about 3/16 of an inch.

22. A mounted wall, comprising:

the mounting system of claim 18; and a wall member secured within the C-channel member.

* * * * *